US011850869B2

(12) United States Patent
Paulson et al.

(10) Patent No.: US 11,850,869 B2
(45) Date of Patent: Dec. 26, 2023

(54) RETRANSFER PRINTER WITH PLATEN ROLLER HOMING

(71) Applicant: Entrust Corporation, Shakopee, MN (US)

(72) Inventors: Arthur J. Paulson, Shakopee, MN (US); Robert J. MacDonald, Shakopee, MN (US); Ivan Lopez Espinosa, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 111 days.

(21) Appl. No.: 17/644,851

(22) Filed: Dec. 17, 2021

(65) Prior Publication Data

US 2022/0194094 A1 Jun. 23, 2022

Related U.S. Application Data

(60) Provisional application No. 63/126,931, filed on Dec. 17, 2020.

(51) Int. Cl.
*B41J 2/325* (2006.01)

(52) U.S. Cl.
CPC ..... *B41J 2/325* (2013.01)

(58) Field of Classification Search
CPC ... B41J 2/325; B41J 33/34; B41J 2/315; B41J 2/32; B41J 31/06; B41J 31/08; B41J 33/00; B41J 33/14; B41J 33/24; B41J 33/26; B41J 33/28; B41F 16/00; B41F 16/0006; B41F 16/0026; B41F 16/0033
See application file for complete search history.

(56) References Cited

U.S. PATENT DOCUMENTS

| | | | | |
|---|---|---|---|---|
| 6,894,710 | B2 | 5/2005 | Suzuki et al. | |
| 7,119,823 | B2 | 10/2006 | Takahashi et al. | |
| 9,168,774 | B2 | 10/2015 | Lass et al. | |
| 9,505,229 | B2 * | 11/2016 | Kaneoya | B41J 2/325 |
| 9,623,674 | B2 | 4/2017 | Ihara et al. | |
| 9,840,089 | B2 | 12/2017 | Ihara | |
| 9,955,044 | B2 | 4/2018 | Ihara | |

(Continued)

FOREIGN PATENT DOCUMENTS

| | | |
|---|---|---|
| EP | 1262979 A2 | 12/2002 |
| EP | 1262979 A3 | 6/2003 |

(Continued)

OTHER PUBLICATIONS

International Search Report and Written Opinion; International Patent Application No. PCT/IB2021/061956, dated Mar. 24, 2022 (10 pages).

*Primary Examiner* — Kristal Feggins
(74) *Attorney, Agent, or Firm* — Hamre, Schumann, Mueller & Larson, P.C.

(57) ABSTRACT

A printing mechanism of a plastic card retransfer printer includes a platen roller with a homing mechanism attached thereto that automatically returns the platen roller to the same home position at the end of each printing pass. The homing mechanism ensures that the portion of the retransfer film being printed on travels over the same surfaces of the platen roller in each print pass. Therefore, any variations in the surface of the platen roller will manifest themselves at the same locations on the resulting printing on the retransfer film.

15 Claims, 6 Drawing Sheets

(56) References Cited

U.S. PATENT DOCUMENTS

| | | | | |
|---|---|---|---|---|
| 9,962,976 | B2 | 5/2018 | Lass et al. | |
| 10,114,993 | B2 | 10/2018 | Torchalski et al. | |
| 2002/0168205 | A1 | 11/2002 | Suden et al. | |
| 2004/0207714 | A1 | 10/2004 | Takahashi et al. | |
| 2005/0105949 | A1 | 5/2005 | Suden et al. | |
| 2006/0049253 | A1 | 3/2006 | Butler | |
| 2008/0074269 | A1 | 3/2008 | Torchalski et al. | |
| 2009/0278911 | A1* | 11/2009 | Howell | B41J 35/26 428/32.6 |
| 2012/0286464 | A1 | 11/2012 | Takei et al. | |
| 2013/0177343 | A1 | 7/2013 | Lass et al. | |
| 2015/0242667 | A1 | 8/2015 | Torchalski et al. | |
| 2016/0082758 | A1 | 3/2016 | Lass et al. | |
| 2016/0271969 | A1 | 9/2016 | Ihara | |
| 2016/0300128 | A1 | 10/2016 | Alvig et al. | |
| 2016/0325556 | A1 | 11/2016 | Ihara et al. | |
| 2017/0008302 | A1 | 1/2017 | Ihara | |
| 2017/0026551 | A1 | 1/2017 | Ihara | |
| 2017/0041495 | A1 | 2/2017 | Ihara | |

FOREIGN PATENT DOCUMENTS

| | | | |
|---|---|---|---|
| EP | 1468831 | A1 | 10/2004 |
| EP | 1468831 | B1 | 10/2004 |
| EP | 1262979 | B1 | 7/2005 |
| EP | 1564744 | A2 | 8/2005 |
| EP | 1564744 | A3 | 9/2005 |
| EP | 1564744 | B1 | 1/2009 |
| EP | 2064659 | B1 | 12/2011 |
| JP | S59076261 | A | 5/1984 |
| JP | S59076262 | A | 5/1984 |
| JP | 62013372 | A | 1/1987 |
| JP | H01204780 | A | 8/1989 |
| JP | H02248253 | A | 10/1990 |
| JP | H03189152 | A | 8/1991 |
| JP | H08039844 | A | 2/1996 |
| JP | H08052887 | A | 2/1996 |
| JP | H01080540 | A | 3/1996 |
| JP | H08058125 | A | 3/1996 |
| JP | H08067017 | A | 3/1996 |
| JP | H0899420 | A | 4/1996 |
| JP | H08192547 | A | 7/1996 |
| JP | H08332768 | A | 12/1996 |
| JP | H09142003 | A | 6/1997 |
| JP | H09174901 | A | 7/1997 |
| JP | 2000141727 | A | 5/2000 |
| JP | 2000-263993 | A | 9/2000 |
| JP | 2002103655 | A | 4/2002 |
| JP | 2005014398 | A | 1/2005 |
| JP | 2008001012 | A | 1/2008 |
| JP | 2008087164 | A | 4/2008 |
| JP | 2008142995 | A | 6/2008 |
| JP | 2008260292 | A | 10/2008 |
| JP | 4207682 | B2 | 1/2009 |
| JP | 2009072949 | A | 4/2009 |
| JP | 4337582 | B2 | 9/2009 |
| JP | 4747706 | B2 | 8/2011 |
| JP | 2011173393 | A | 9/2011 |
| JP | 2012-116150 | A | 6/2012 |
| JP | 5119822 | B2 | 1/2013 |
| JP | 2017019131 | A | 1/2017 |
| JP | 2017024285 | A | 2/2017 |
| JP | 2017030316 | A | 2/2017 |
| JP | 2017170715 | A | 9/2017 |
| JP | 2018043807 | A | 3/2018 |
| JP | 2018047554 | A | 3/2018 |
| JP | 6442299 | B2 | 12/2018 |
| JP | 6449698 | B2 | 12/2018 |
| JP | 6529168 | B2 | 6/2019 |
| JP | 6535557 | B2 | 6/2019 |
| JP | 6573790 | B2 | 9/2019 |
| JP | 6700888 | B2 | 5/2020 |
| KR | 10-2009-0101705 | A | 9/2009 |
| WO | 2008/036907 | A2 | 3/2008 |
| WO | 2008/036907 | A3 | 3/2008 |
| WO | 2012077709 | A1 | 6/2012 |
| WO | 2016/047226 | A1 | 3/2016 |
| WO | 2020/050074 | A1 | 3/2020 |

* cited by examiner

RETRANSFER PRINTER WITH PLATEN ROLLER HOMING

FIELD

This technical disclosure relates to a retransfer printer for performing retransfer printing on plastic cards or passport pages.

BACKGROUND

Retransfer printing is a well-known printing process for printing plastic cards. In one known implementation, printing is performed on a retransfer film in a print station, typically in multiple print passes with each print pass printing a different color onto the retransfer film. When printing is complete, the portion of the retransfer film containing the printing is advanced to a transfer station and transferred to a substrate such as to the surface of a plastic card-shaped substrate.

SUMMARY

A printing mechanism of a plastic card retransfer printer is described herein. The printing mechanism includes a platen roller with a homing mechanism attached thereto that automatically returns the platen roller to the same home position at the end of each printing pass. The homing mechanism ensures that the portion of the retransfer film being printed on travels over the same surfaces of the platen roller in each print pass. Therefore, any variations in the surface of the platen roller will manifest themselves at the same locations on the resulting printing on the retransfer film.

The platen roller homing technique described herein can be used with any multi-pass retransfer printing including multiple print passes that print on a single portion of the retransfer film during each pass and the single portion is then transferred to the substrate.

The homing mechanism can have any construction that is suitable for automatically returning the platen roller to the same home position after each print pass. In one embodiment, the homing mechanism can use magnetics to return the platen roller to the home position. However, other techniques for returning the platen roller to the same home position after each print pass can be used. The home position can be the same for each print job, where each print job comprises multiple print passes. In another embodiment, the home position can vary between print jobs, as long as the same home position is maintained for each print pass within a print job. The platen roller can be free-wheeling, or the platen roller can be driven and provided with a decoupling or declutching release mechanism to allow the platen roller to free-wheel long enough to permit the platen roller to be returned to the home position without requiring a position sensor or a mechanism, such as a step counter, to keep track of the platen roller position.

In one embodiment described herein, a plastic card retransfer printing mechanism can include a print station having a thermal printhead and a platen roller opposite the thermal printhead, where the platen roller is movable toward and away from the thermal printhead between a printing position and a non-printing position, and the platen roller is circumferentially rotatable from a home position during a printing pass. A print ribbon is arranged to travel between the thermal printhead and the platen roller, and a retransfer film is arranged to travel between the print ribbon and the platen roller. A homing mechanism is operably coupled to (i.e. attached, directly or indirectly to) the platen roller, where the homing mechanism is configured to circumferentially rotate the platen roller and automatically return the platen roller to the home position at the end of the printing pass. A transfer station is also provided at which printing that is printed on the retransfer film at the print station is transferrable onto a plastic card.

In another embodiment described herein, a method of retransfer printing on a plastic card includes in a first print pass in a print station, printing begins on a portion of the retransfer film with the platen roller at the home position and printing ends with the platen roller circumferentially displaced from the home position. Thereafter, the platen roller is circumferentially rotated to return the platen roller to the home position. Thereafter, in a second print pass in the print station, printing begins on the portion of the retransfer film with the platen roller at the home position and printing ends with the platen roller circumferentially displaced from the home position.

The plastic card described herein can include, but is not limited to, a financial (e.g., credit, debit, or the like) card, a driver's license, a national identification card, a business identification card, a gift card, and other plastic cards which bear personalized data unique to the cardholder and/or which bear other card information. In some embodiments, the substrate being printed on by the retransfer printer described herein can be a page of a passport.

DRAWINGS

DETAILED DESCRIPTION

The following is a detailed description of a plastic card retransfer printer and a retransfer printing mechanism of the plastic card retransfer printer. The retransfer printing mechanism is configured to perform retransfer printing on a plastic card. The retransfer printing mechanism will be described and illustrated as being a multi-pass retransfer printing mechanism that performs multiple print passes, each print pass printing on a single portion or section of a retransfer film, and the single portion containing the printing is then transferred to a plastic card-shaped substrate.

As described in further detail below, the retransfer printing mechanism includes a platen roller with a homing mechanism attached thereto that automatically returns the platen roller to the same home position at the end of each printing pass. The homing mechanism ensures that the portion of the retransfer film being printed on travels over the same surfaces of the platen roller in each print pass.

The retransfer printer and retransfer printing mechanism may also be referred to as a card personalization machine or card personalization system. The card personalization machine can be a desktop card personalization machine that is designed to personalize plastic cards one at a time, for example on the order of tens or hundreds per hour, or a central issuance system that is designed to simultaneously personalize multiple plastic cards, for example on the order of thousands per hour.

Figure 1:
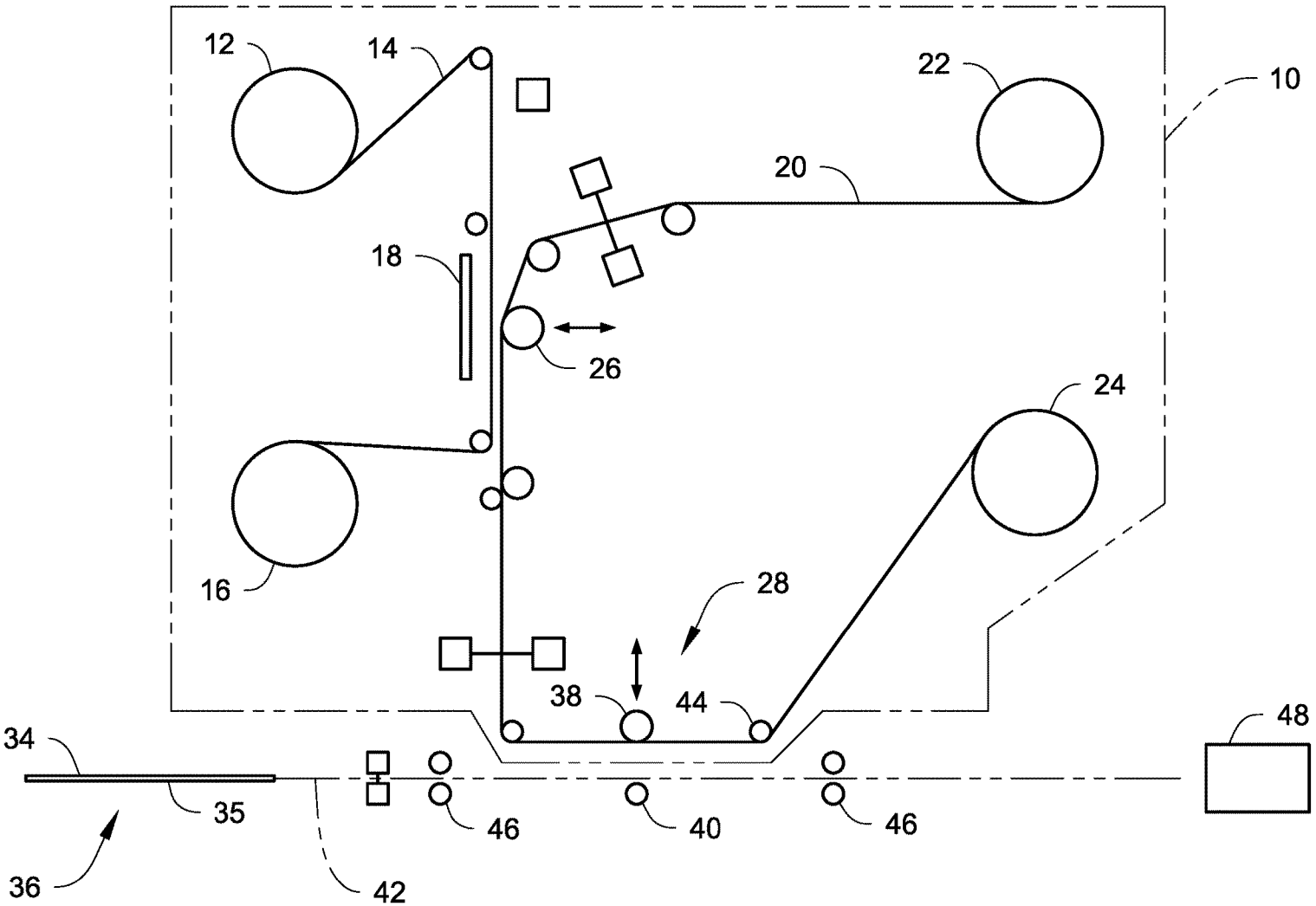
FIG. 1 illustrates a portion of a retransfer printing mechanism that can implement the platen roller homing described herein.

The general construction and operation of plastic card retransfer printing mechanisms is well known in the art. Referring to FIG. 1, an example of a plastic card retransfer printing mechanism 10 is illustrated. The mechanism 10 is part of a card personalization machine. An example of a card personalization machine that can perform retransfer printing is described in U.S. Published Application No. 2016/0300128 filed on Apr. 8, 2016, which is incorporated herein by reference in its entirety. The specific construction and operation of retransfer printers, including the print ribbon, the retransfer film, printing an image on the retransfer film, and transferring the printed image onto a surface of a card, is well known in the art. One example of retransfer printing is disclosed in U.S. Pat. No. 6,894,710 among many others. U.S. Pat. No. 6,894,710 is incorporated herein by reference in its entirety.

The illustrated retransfer printing configuration of the mechanism 10 includes a print side that includes a print ribbon supply 12 from which a supply of print ribbon 14 is supplied, and a print ribbon take-up 16 that takes-up used print ribbon 14. The print ribbon is directed past a print head 18, which in the illustrated example can be stationary, and which conducts printing using the print ribbon 14 onto a retransfer film 20. After printing, the used print ribbon 14 is then wound onto the take-up 16.

Figure 6:
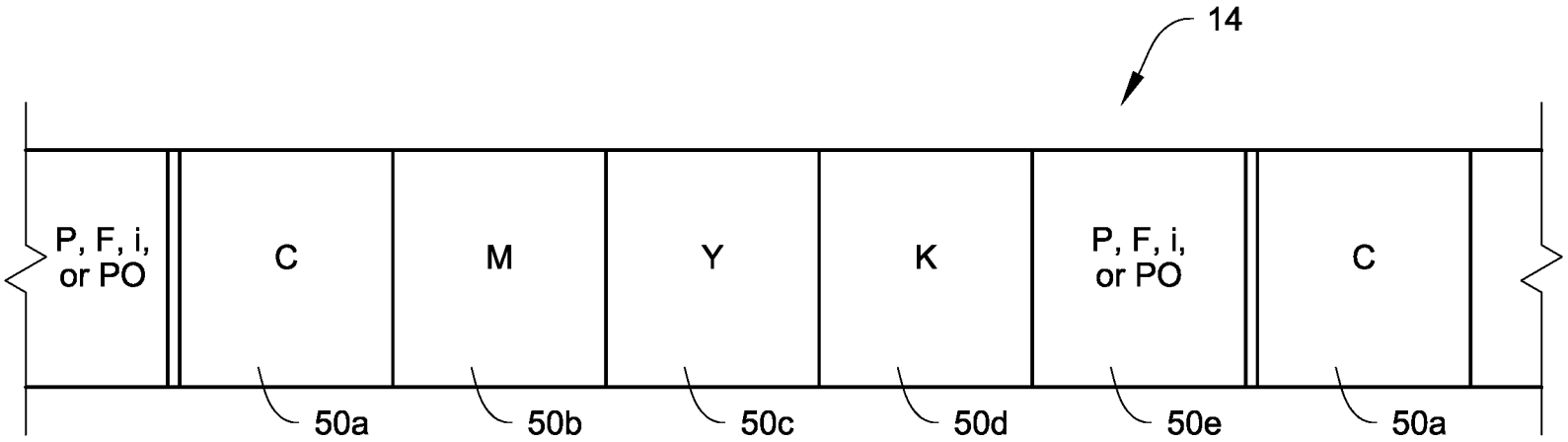
FIG. 6 illustrates a portion of a multicolor print ribbon that can be used with the retransfer printing mechanism.

The print ribbon 14 can be any print ribbon that is suitable for performing the printing described herein. For example, referring to FIG. 6, the print ribbon 14 can be a multicolor print ribbon that includes a repeating sequence of discrete panels 50*a*, 50*b*, 50*c* . . . 50*n* of printable material. In one embodiment, some of the panels on the print ribbon 14 can contain a colorant material such as a colored (i.e. non-transparent) dye or pigment for performing color printing on a transfer area(s) of the retransfer film 20. For example, in one embodiment, examples of colorant material panels include but are not limited to cyan, magenta, yellow and black (CMYK) colorant material panels. Some of the panels may also be a layer of material to improve adhesion, such as a layer of primer (P) material, a layer of fluorescent (F) material, an inhibitor (i) or peel off (PO) layer that blocks stray adhesion, and other layers. The fluorescent material (if used) is generally transparent to allow viewing of printing that may end up underneath the fluorescent material once the fluorescent material printed onto the retransfer film 20 is transferred to the substrate. In addition, some of the panels can contain an additional or specialty colorant material that is not CMYK colorant material. Examples of additional or specialty colorant materials include, but are not limited to, a silver colorant material and/or a gold colorant material.

The print ribbon 14 can include any combinations of printable materials that one may wish to print onto the retransfer film 20. For example, in one non-limiting embodiment, the sequence of panels on the print ribbon 14 can be as follows: cyan color panel 50*a*; magenta color panel 50*b*; yellow color panel 50*c*; black color panel 50*d*; a primer material panel or fluorescent material panel or inhibitor/peel off panel 50*e*, with this sequence repeated over the length of the print ribbon 14. Many other panel sequences of the print ribbon 14 are possible.

Referring back to FIG. 1, the retransfer film 20 is supplied from a film supply 22 on a retransfer side, and after retransfer the remaining film 20 is wound onto a film take-up 24 also on the retransfer side. The retransfer film 20 is directed past a platen roller 26 positioned opposite the print head 18 and which in the illustrated example can be moved toward and away from the print head 18 to press the retransfer film 20 and the print ribbon 14 between the print head 18 and the platen roller 26 during printing onto the retransfer film 20. The retransfer film 20 can be any retransfer film 20 that has a transferrable material layer(s) that can be transferred from the retransfer film 20 onto the substrate.

Figure 7:
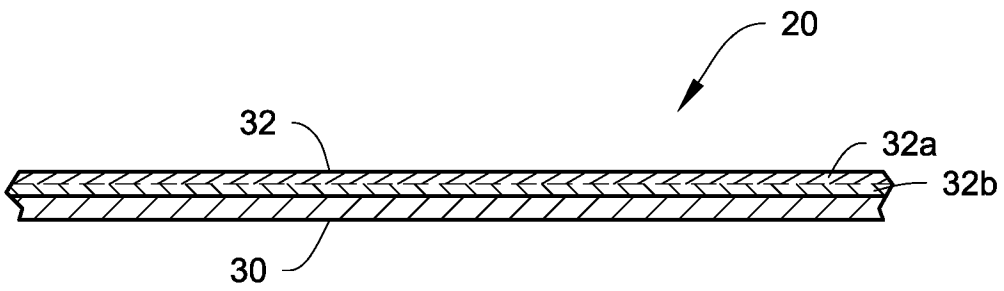
FIG. 7 is a cross-sectional view taken through the retransfer film.

The construction of retransfer films is well known in the art. Referring to FIG. 7, the retransfer film 20 includes a carrier layer 30 and a transferrable material layer 32. In use, printing is performed on a portion of the transferrable material layer 32. Once printing is complete, the portion of the transferrable material layer 32 containing the printing is transferred onto a plastic card. The transferrable material layer 32 may be a single layer or composed of multiple layers. For example, as depicted in FIG. 7, the layer 32 may include a layer 32*a* that receives the printing and a layer 32*b* that forms a protective layer when the layer is transferred to the plastic card. The transferrable material layer 32 may include other layers having useful properties.

Returning to FIG. 1, once printing is complete, the section of the retransfer film 20 with the printing is advanced to a transfer station 28 where the transferrable material layer containing the printing is transferred onto a card 36. In this example, the transfer station 28 includes a heated transfer mechanism 38, for example a transfer roller, that is movable toward and away from a fixed platen 40 positioned on the opposite side of a card travel or transport path 42. The heated transfer mechanism 38 presses the portions of the retransfer film 20 containing the printing against the card 36 which is backed by the platen 40, with the retransfer film 20 and the card 36 then being transported together past the heated transfer mechanism 38 to transfer the transferrable material layer(s) of the retransfer film 20 containing the printing onto the card 36. The retransfer film 20 and the card 36 are then transported to a stripping station 44 where the transferrable material layer(s) of the retransfer film 20 is stripped from the card 36 leaving behind the transferrable material layer containing the printing on the card 36. The remainder of the retransfer film 20, minus the transferred material layer is then wound onto the film take-up 24. The card 36 is transported along the card travel path 42 by a card transport mechanism, such as sets of rollers 46.

In some embodiments, for example where printing on both surfaces of the card 36 is desired, an optional card reorienting mechanism 48 (or card flipper 48) can be located downstream of the stripping station 44 in the card travel path 38. The card reorienting mechanism 48 can receive the card 36 after the printed transferrable material layer has been applied to the surface 34 of the card 36, and flip the card 36 over (i.e. flip the card 180 degrees) so that the opposite surface 35 is now facing upward. The card 36 can then be transported back upstream of the transfer station 28 in order to retransfer print a printed image onto the opposite surface 35. In embodiments where printing on the opposite surface 35 is not required, the card reorienting mechanism 48 is not required and can be removed, or the card 36 can be transported through the card reorienting mechanism 48 without flipping the card 36.

Figure 5:
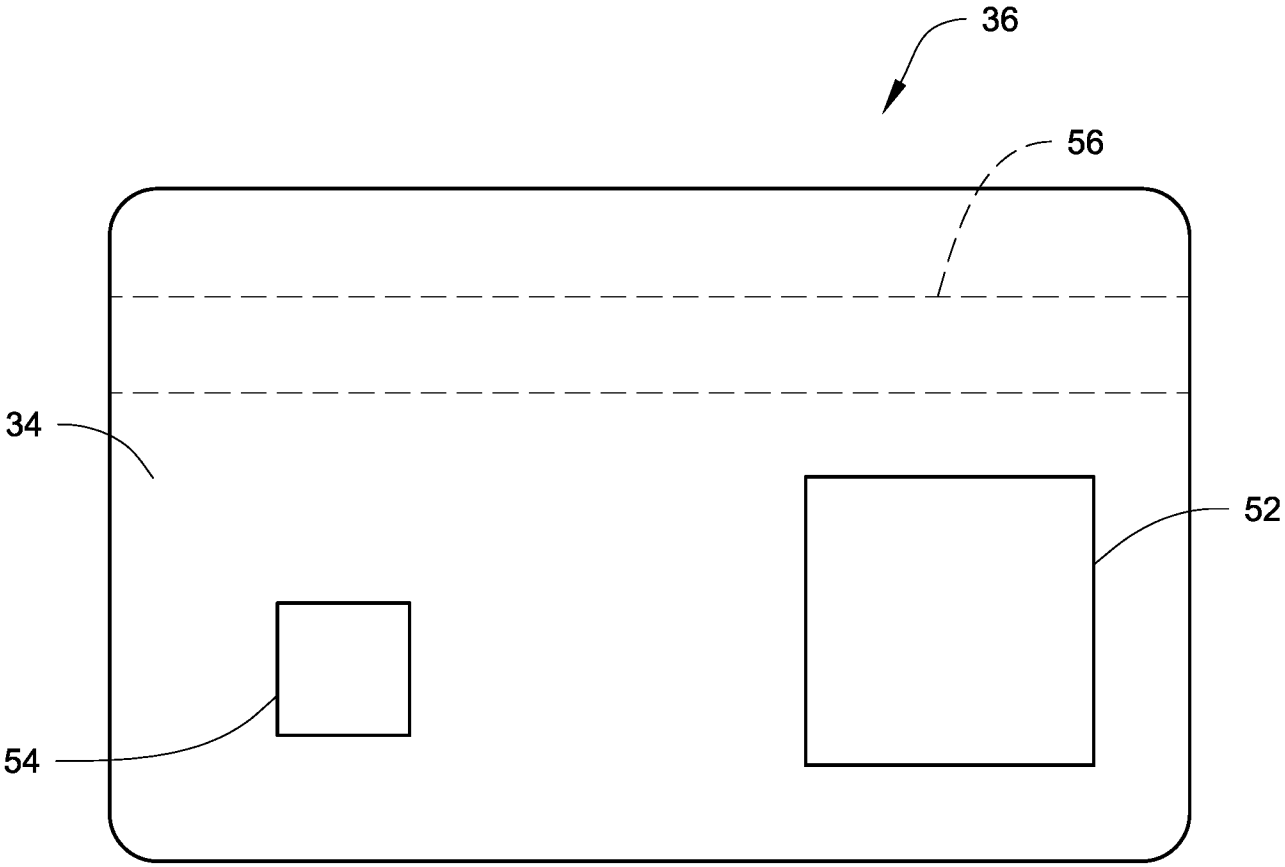
FIG. 5 is a top view of an example of a plastic card that has been printed by the retransfer printing mechanism.

An example of the card 36 after printing is illustrated in FIG. 5. The card 36 can include printing on the surface 34 and/or on the surface 35 (seen in FIG. 1). The printing can include an image 52 such as a portrait image of the intended cardholder. The printing can also include graphics such as a background image (not shown) of the card 36. The printing can also include text data such as letters, numbers or combinations thereof, such as an account number, name and address of the intended cardholder, an expiration date, one or more bar codes or other machine readable elements, fluorescent elements, and the like. The card 36 can also include an integrated circuit chip 54, which can be of the contact type or contactless type, and/or a magnetic strip 56.

Returning to FIG. 1, the printing on the retransfer film 20 takes place as follows. With the platen roller 26 actuated to a retracted or non-printing position away from the printhead 18, the print ribbon 14 and the retransfer film 20 are aligned with one another using known alignment techniques between the printhead 18 and the platen roller 26. The platen roller 26 is then actuated toward the printhead 18 to a printing position, and then the print ribbon 14 and the retransfer film 20 are advanced together in a first print pass past the printhead 18 to print on the retransfer film 20. During printing, the platen roller 26 rotates with the retransfer film 20 as it is advanced together with the print ribbon 14. The platen roller 26 is mounted to freely rotate about its longitudinal axis. At the end of the first print pass, the platen roller 26 is actuated to the non-printing position and the retransfer film 20 is then reversed to align the portion of the retransfer film to be printed with the next panel of the print ribbon 14. The platen roller 26 is then actuated toward the printhead 18 to a printing position, and then the print ribbon 14 and the retransfer film 20 are advanced together in a second print pass past the printhead 18 to print on the retransfer film 20. This process is repeated until the printing is complete, at which time the completed printing can be advanced to the transfer station 28 to transfer the printing.

Figure 2A:
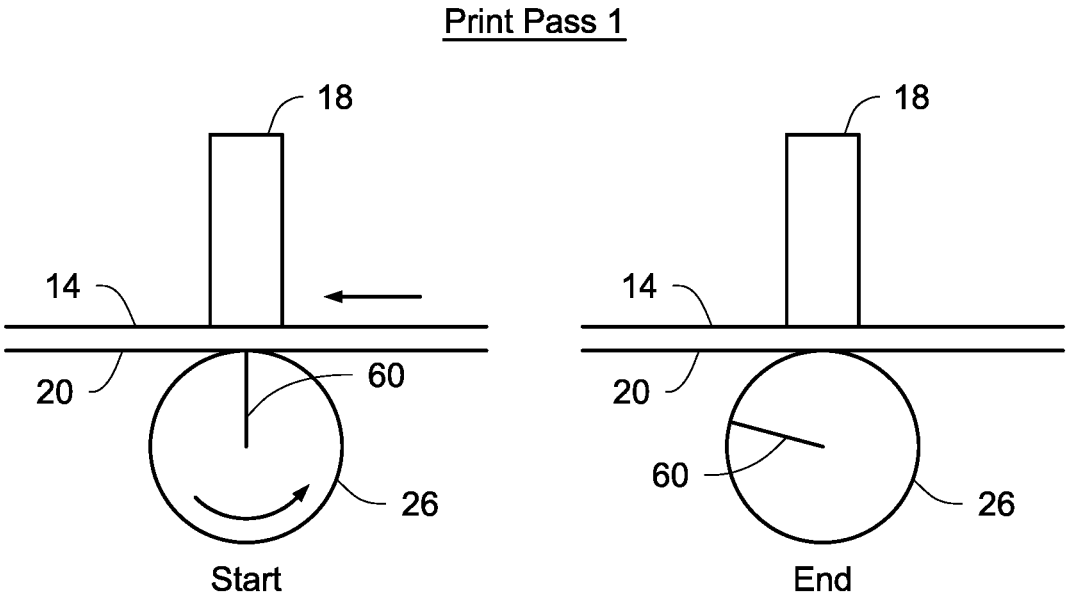
Fig. 2A (Prior Art)
FIGS. 2A and 2B illustrate the platen roller in a conventional retransfer printing mechanism.
Figure 2B:
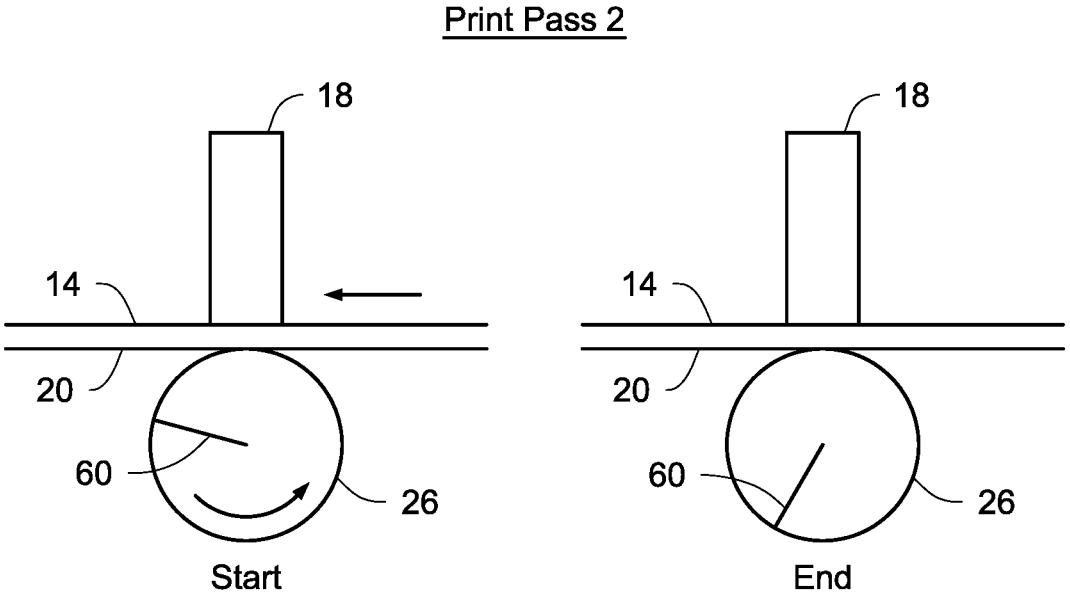
Fig. 2B (Prior Art)

During each print pass, the platen roller 26 rotates with the retransfer film 20 as it is advanced together with the print ribbon 14 for example in a direction of the arrow from right to left in FIGS. 2A and 2B. The print ribbon 14 and the retransfer film 20 are depicted with a gap therebetween for ease in illustrating each element. In actuality, the print ribbon 14 and the retransfer film 20 would be in intimate contact with each other. In a conventional retransfer printing mechanism shown in FIGS. 2A and 2B, because of the rotation of the platen roller 26, the surface of the platen roller 26 is located at a different circumferential position in each print pass. Therefore, the retransfer ribbon 20 travels over different portions of the platen roller 26 in each print pass. For example, referring to FIG. 2A, a mark 60 is indicated on the platen roller 26. The mark 60 is depicted for help in explaining the concepts described herein; in use, the mark 60 may or may not be present. At the start of the first print pass, the mark 60 is indicated at the location shown at the left in FIG. 2A which can be referred to as a home position, and at the end of the first print pass, the mark 60 may end up at the location indicated due to rotation of the platen roller 26. In the second print pass indicated in FIG. 2B after the platen roller 26 is retracted to the non-printing position and the retransfer film 20 is rewound to reposition the retransfer film 20 for the second print pass, the second print pass begins with the mark 60 located as indicated and at the end of the second print pass the mark 60 may be located at the position shown on the right due to rotation of the platen roller 26. Additional print passes are similar. Because the retransfer ribbon 20 passes over different portions of the platen roller 26 in each print pass, any variations in the surface of the platen roller will manifest themselves at different locations on the resulting printing on the retransfer film 20.

Figure 3A:
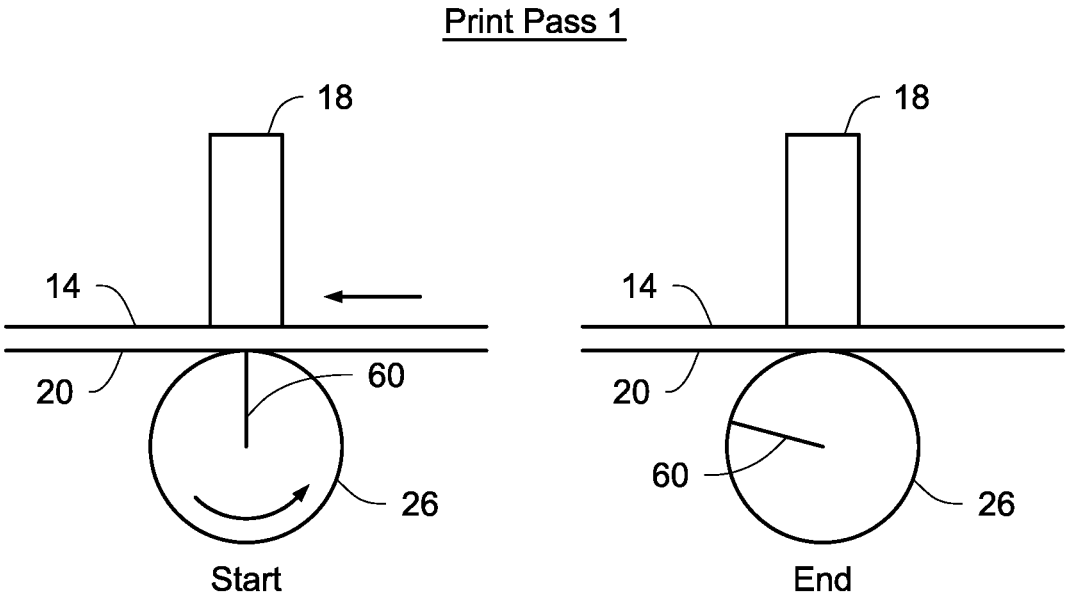
FIGS. 3A and 3B illustrate the platen roller homing described herein.
Figure 3B:
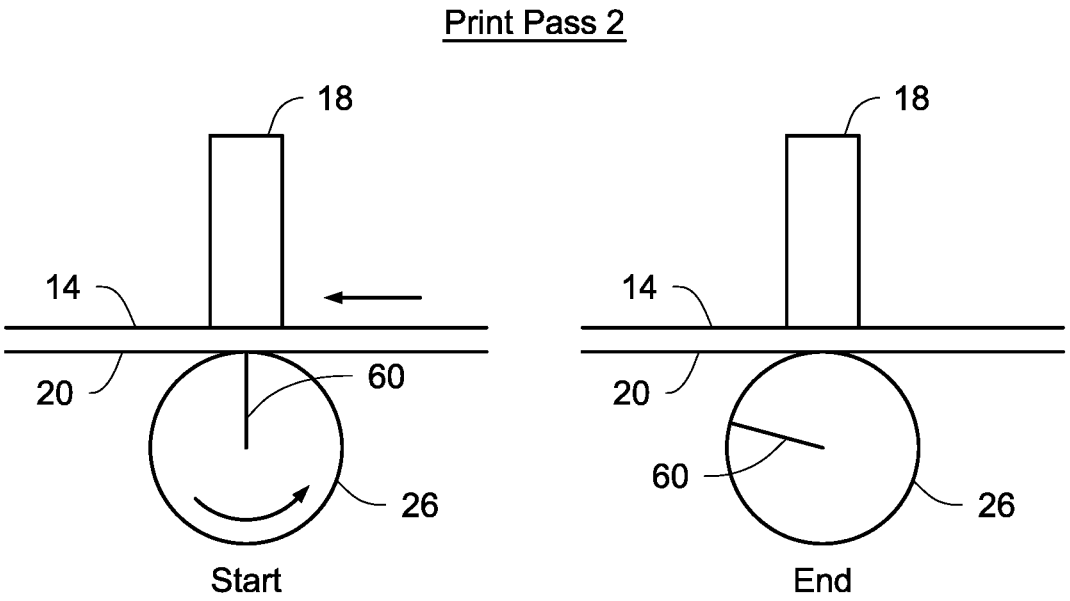

In contrast, in the retransfer printing mechanism 10 described herein, at the end of each print pass, the platen roller 26 is automatically rotated back to the home or start position. The return of the platen roller 26 to the home position can be referred to as homing. For example, referring to FIGS. 3A and 3B, at the start of the first print pass, the mark 60 is indicated at the location shown at the left in FIG. 3A at the home position, and at the end of the first print pass indicated at the right in FIG. 3A, the mark 60 may end up at the location indicated due to rotation of the platen roller 26. The platen roller 26 is then retracted to the non-printing position and the retransfer film 20 is rewound to reposition the retransfer film 20 for the second print pass. The platen roller 26 is also automatically returned to the home position so that in the second print pass indicated in FIG. 3B, the second print pass begins with the platen roller 26 back at the home position (shown by the mark 60) and at the end of the second print pass the mark 60 may be located at the position shown on the right due to rotation of the platen roller 26. Additional print passes are similar. Because the portion of the retransfer ribbon 20 being printed on passes over the same portions of the platen roller 26 in each print pass, any variations in the surface of the platen roller will manifest themselves at the same locations on the resulting printing on the retransfer film 20.

The homing of the platen roller 26 can be achieved using a homing mechanism that is operably coupled to (i.e. attached, directly or indirectly to) the platen roller 26. The homing mechanism can have any construction that is suitable for automatically returning the platen roller 26 to the same home position after each print pass. In one embodiment described further below with respect to FIG. 4, the homing mechanism can use magnetics to return the platen roller 26 to the home position. However, other homing mechanisms that do not utilize magnetics can be used. In one embodiment, the home position can be the same for each print job, where each print job comprises multiple print passes. In another embodiment, the home position can vary between print jobs, as long as the same home position is maintained for each print pass within a print job.

Figure 4:
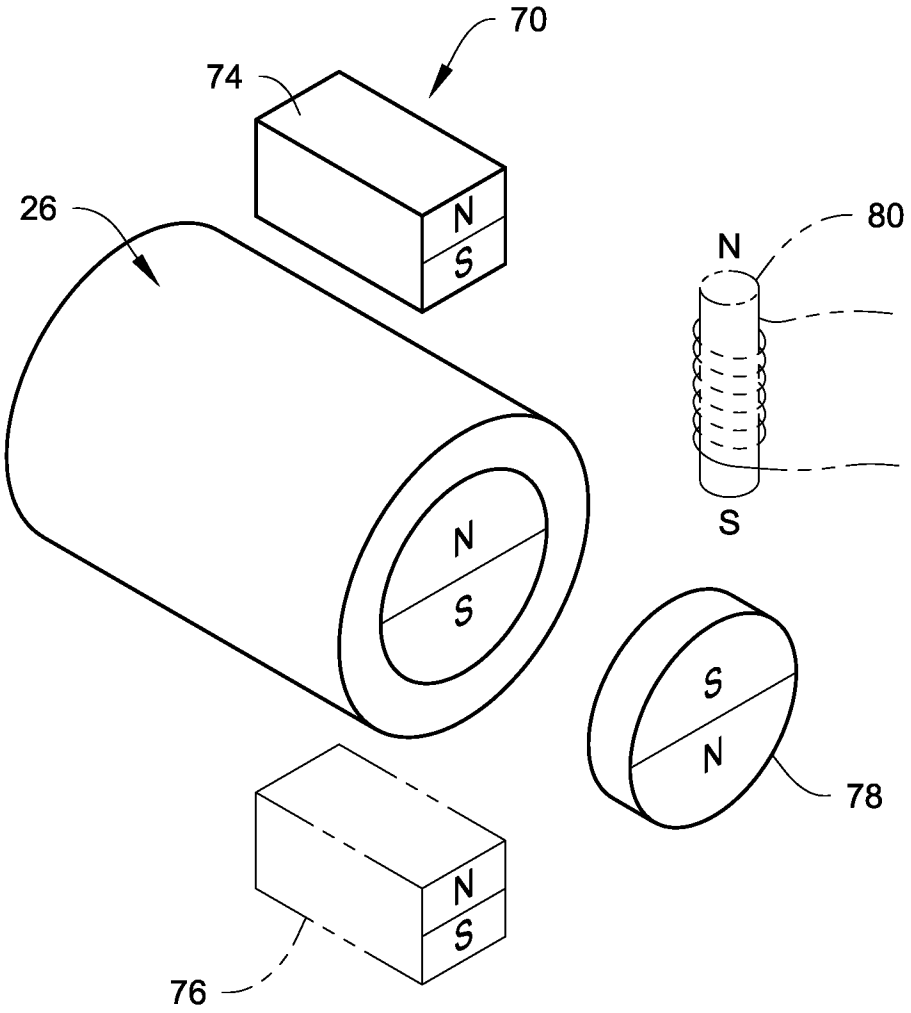
FIG. 4 illustrates examples of homing mechanisms that can be used on the platen roller.

Referring to FIG. 4, an example of a homing mechanism 70 associated with the platen roller 26 is illustrated. In this example, the homing mechanism 70 is a magnetic homing mechanism that is directly attached to the platen roller 26. In particular, the homing mechanism 70 includes a magnet 72 attached to and rotatable with the platen roller 26, for example at an end of the platen roller 26. In the illustrated example, the north (N) and south (S) poles of the magnet 72 can be positioned as indicated. The homing mechanism 70 further includes at least one magnet 74 that is fixed in position (i.e. does not rotate with the platen roller 26) at a location off of the platen roller 26 at a location to be able to magnetically interact with the magnet 72. For example, the magnet 74 can be mounted on a fixed portion of a chassis of the card printer in which the platen roller 26 is mounted, for example above the magnet 72. The magnet 74 is oriented so that the south (S) pole thereof is oriented toward the magnet 72. With this construction and orientation of the magnets 72, 74, the platen roller 26 is automatically returned to the same home position at the end of each print pass due to the magnetic attraction forces between the north (N) and south (S) poles of the magnets 72, 74 and the magnetic repulsion forces between the same poles of the magnets 72, 74. As used herein, the home position is considered to be ±5 degrees from a nominal home position.

With continued reference to FIG. 4, in another embodiment, a second fixed-position magnet 76 can be provided diametrically opposite the magnet 74. The second magnet 76 can be used in addition to the magnet 74 or in place of the magnet 74. In still another embodiment, instead of the magnets 74, 76, a fixed position magnet 78 can be fixed in position facing the axial end of the platen roller 26 and the magnet 72 to automatically return the platen roller 26 to the home position. In still another embodiment, instead of the magnets 74, 76, 78, a fixed position electromagnet 80 can be used to interact with the magnet 72 to automatically return the platen roller 26 to the home position.

Many other combinations, orientations, locations, constructions and the like of magnets and electromagnets can be used as long as the platen roller 26 can be magnetically returned to the home position after each print pass. In addition, the homing mechanism 70 is not limited to using magnetics to return the platen roller 26 to the home position. Other mechanisms, such as resilient biasing mechanisms using springs or other resilient biasing devices, can be used. In addition, a drive mechanism with a drive motor can be connected to the platen roller 26 to drive the platen roller 26 to the home position.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plastic card retransfer printing mechanism, comprising:

a print station that includes a thermal printhead and a platen roller opposite the thermal printhead, the platen roller is movable toward and away from the thermal printhead between a printing position and a non-printing position, and the platen roller is circumferentially rotatable from a home position during a printing pass;

a print ribbon between the thermal printhead and the platen roller;

a retransfer film between the print ribbon and the platen roller;

a homing mechanism operably coupled to the platen roller, the homing mechanism is configured to circumferentially rotate the platen roller and automatically return the platen roller to the home position at the end of the printing pass;

a transfer station at which printing that is printed on the retransfer film at the print station is transferrable onto a plastic card.

2. The plastic card retransfer printing mechanism of claim 1, wherein the homing mechanism is configured to operate using magnetic attraction or repulsion forces.

3. The plastic card retransfer printing mechanism of claim 1, wherein the homing mechanism comprises a first magnet attached to and rotatable with the platen roller.

4. The plastic card retransfer printing mechanism of claim 3, wherein the homing mechanism further comprises a second magnet fixed in position adjacent to the platen roller whereby the second magnet does not rotate with the platen roller, wherein the second magnet is positioned to magnetically interact with the first magnet.

5. The plastic card retransfer printing mechanism of claim 1, wherein the print ribbon is a multicolor print ribbon.

6. The plastic card retransfer printing mechanism of claim 5, wherein the multicolor print ribbon comprises a plurality of cyan, magenta, yellow and black panels.

7. The plastic card retransfer printing mechanism of claim 6, wherein the multicolor print ribbon further comprises a plurality of overlay panels and/or a plurality of topcoat panels.

8. The plastic card retransfer printing mechanism of claim 1, wherein the home position is ±5 degrees from a nominal home position.

9. A method of retransfer printing on a plastic card in a retransfer printer having a print station that includes a thermal printhead and a platen roller opposite the thermal printhead, the platen roller is movable toward and away from the thermal printhead between a printing position and a non-printing position, and the platen roller is circumferentially rotatable from a home position during a printing pass; a print ribbon between the thermal printhead and the platen roller; a retransfer film between the print ribbon and the platen roller; and a transfer station at which printing that is printed on the retransfer film at the print station is transferrable onto the plastic card, the method comprising:

in a first print pass in the print station, begin printing on a portion of the retransfer film with the platen roller at the home position and end printing on the portion of the retransfer film with the platen roller circumferentially displaced from the home position;

thereafter circumferentially rotating the platen roller to return the platen roller to the home position;

thereafter, in a second print pass in the print station, begin printing on the portion of the retransfer film with the platen roller at the home position and end printing on the portion of the retransfer film with the platen roller circumferentially displaced from the home position.

10. The method of claim 9, wherein circumferentially rotating the platen roller to return the platen roller to the home position comprises using magnetic attraction or repulsion forces to circumferentially rotate the platen roller to the home position.

11. The method of claim 9, wherein circumferentially rotating the platen roller to return the platen roller to the home position comprises using a first magnet attached to and rotatable with the platen roller to circumferentially rotate the platen roller to the home position.

12. The method of claim 11, wherein circumferentially rotating the platen roller to return the platen roller to the home position comprises using a second magnet fixed in position adjacent to the platen roller so that the second magnet does not rotate with the platen roller when the platen roller is circumferentially rotated to the home position, wherein the second magnet magnetically interacts with the first magnet.

13. The method of claim 9, comprising:

in the first print pass, printing a first color on the portion of the retransfer film;

in the second print pass, printing a second color on the portion of the retransfer film, where the second color differs from the first color.

14. The method of claim 13, after the second print pass, circumferentially rotating the platen roller to return the platen roller to the home position;

and in a third print pass, begin printing on the portion of the retransfer film with the platen roller at the home position and end printing on the portion of the retransfer film with the platen roller circumferentially displaced from the home position, the third print pass printing a topcoat or an overlay on the portion of the retransfer film.

15. The method of claim 9, further comprising advancing the portion of the retransfer film containing the printing to the transfer station, and transferring the portion onto the plastic card.

* * * * *